US012017823B2

(12) United States Patent
Aldana

(10) Patent No.: US 12,017,823 B2
(45) Date of Patent: Jun. 25, 2024

(54) DEVICE RETENTION ASSEMBLIES

(71) Applicant: Microsoft Technology Licensing, LLC, Redmond, WA (US)

(72) Inventor: Leonardo Aldana, Tracy, CA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 184 days.

(21) Appl. No.: 17/397,438

(22) Filed: Aug. 9, 2021

(65) Prior Publication Data

US 2023/0038635 A1 Feb. 9, 2023

(51) Int. Cl.

*B65D 45/18* (2006.01)
*B65D 43/02* (2006.01)
*B65D 53/02* (2006.01)

(52) U.S. Cl.

CPC ..... *B65D 45/18* (2013.01); *B65D 43/0202* (2013.01); *B65D 53/02* (2013.01); *B65D 2251/205* (2013.01); *B65D 2313/00* (2013.01); *B65D 2585/86* (2013.01)

(58) Field of Classification Search

CPC .... B65D 45/18; B65D 43/0202; B65D 53/02; B65D 2251/205; B65D 2313/00; B65D 2585/86

USPC ..... 220/319, 325

See application file for complete search history.

(56) References Cited

U.S. PATENT DOCUMENTS 1,480,782 A * 1/1924 Primeau ..... A47J 27/0804 220/325
1,941,294 A * 12/1933 Eck ..... A47J 27/0811 220/325
2,074,475 A * 3/1937 Jesser ..... B65D 45/18 24/546
3,070,254 A * 12/1962 Carse ..... B67D 1/0801 277/921
3,762,595 A * 10/1973 Green ..... B65D 51/1666 220/325
4,253,583 A * 3/1981 Lynch ..... F16J 13/065 220/327

(Continued)

FOREIGN PATENT DOCUMENTS

CN 112498965 A * 3/2021
EP 0919188 B1 6/2004

(Continued)

OTHER PUBLICATIONS

"LifePod", Retrieved From: https://web.archive.org/web/20210128114110/https:/vaulteksafe.com/products/vaultek-view-all-lifepod-series/lifepod/, Jan. 28, 2021, 17 Pages.

(Continued)

*Primary Examiner* — James N Smalley

(74) *Attorney, Agent, or Firm* — Rainier Patents, P.S.

(57) ABSTRACT

The description relates to device retention assemblies. One example can include a bucket having an open end and defining a volume that contains electronic components. The example can also include a lid positioned over the open end of the bucket. A retention assembly can be configured to bias the lid against the bucket to seal the open end. The retention assembly can include a tab that is secured to the lid with a fastener that extends through the retention assembly into the lid without extending completely through the lid and does not contact the bucket.

17 Claims, 9 Drawing Sheets

(56) References Cited

U.S. PATENT DOCUMENTS

| | | | | |
|---|---|---|---|---|
| 4,565,297 | A * | 1/1986 | Korner | F16J 15/48 220/582 |
| 4,732,294 | A * | 3/1988 | Bohler | B65D 45/32 220/300 |
| 5,423,419 | A | 6/1995 | Wentz et al. | |
| 7,748,158 | B2 | 7/2010 | Wieringa et al. | |
| 10,247,514 | B2 | 4/2019 | Chambers | |
| 2005/0061817 | A1* | 3/2005 | Bryant | B65D 45/16 220/325 |
| 2009/0152271 | A1* | 6/2009 | Kuzelka | B65D 45/345 220/319 |
| 2019/0170178 | A1 | 6/2019 | Leverger et al. | |

FOREIGN PATENT DOCUMENTS

| | | | |
|---|---|---|---|
| KR | 20190012987 | A | 2/2019 |
| KR | 102074403 | B1 | 2/2020 |

OTHER PUBLICATIONS

"Short Picture Frame Retaining Clips", Retrieved From: https://www.amazon.com/Short-Picture-Frame-Retaining-Clips/dp/B01LXC3DEK, Retrieved Date: May 4, 2021, 6 Pages.

"Weck—Jars for Everything", Retrieved From: https://weckjars.com/, Retrieved Date: Aug. 4, 2021, 6 Pages.

Freedberg Jr., Sydney J., "IVAS: Microsoft Award by Army Worth Up To $21.9B", Retrieved From: https://breakingdefense.com/2021/03/ivas-microsoft-award-worth-up-to-21-9b/, Mar. 31, 2021, 6 Pages.

* cited by examiner

SYSTEM 100B
CLIP 126(1)
RETENTION ASSEMBLY 124
FASTENER 130(1)
TAB 128(1)
BLIND HOLE 134(1)
LID 106
DEVICE 102
BUCKET 104
PROTRUSION 502
RECESS 404

SYSTEM 100B
CLIP 126(1)
RETENTION ASSEMBLY 124
TAB 128(1)
LID 106
DEVICE 102
BUCKET 104
PROTRUSION 502
RECESS 404

SYSTEM 100B
LID 106
DEVICE 102
BUCKET 104
PROTRUSION 502
RECESS 404 x
y
z

DEVICE RETENTION ASSEMBLIES

OVERVIEW

The present concepts relate to devices that can include retention assemblies that bias a bucket and a lid together. The retention assemblies can include one or more clips and tabs. The tabs can be secured to the face of the lid without sacrificing barrier integrity of the lid and without engaging the bucket. The tabs can generate a force that can be imparted on the clips to bias the lid and bucket together to create a seal, such as an air and/or water tight seal. Positioning the tabs on the face of the lid can reduce overall dimensions of the device and reduce incidences of tabs inadvertently snagging objects in an operating environment of the device. These and other aspects are described in more detail below.

BRIEF DESCRIPTION OF THE DRAWINGS

The accompanying drawings illustrate implementations of the concepts conveyed in the present document. Features of the illustrated implementations can be more readily understood by reference to the following description taken in conjunction with the accompanying drawings. Like reference numbers in the various drawings are used wherever feasible to indicate like elements. Further, the left-most numeral of each reference number conveys the figure and associated discussion where the reference number is first introduced. Where space permits, elements and their associated reference numbers are both shown on the drawing page for the reader's convenience. Otherwise, only the reference numbers are shown.

DESCRIPTION

The present concepts relate to sealing two components, such as a bucket and a lid. The bucket can include a housing that defines a volume containing electronic components. The bucket can include or define an open end. The lid can be configured to be removably secured to (e.g., over) the open end so that the lid can be removed to access the electronic components and installed to seal the volume, such as from water (e.g., create a waterproof seal). The lid can be removably secured by a retention assembly that can include one or more tabs. To avoid snagging and/or inadvertent opening, the tabs can be positioned on the lid rather than extending along the bucket. Further, rather than being fastened to the bucket, the tabs can be fastened to the lid without penetrating the lid and sacrificing the seal integrity. These and other aspects are described in more detail below.

Figure 1A:
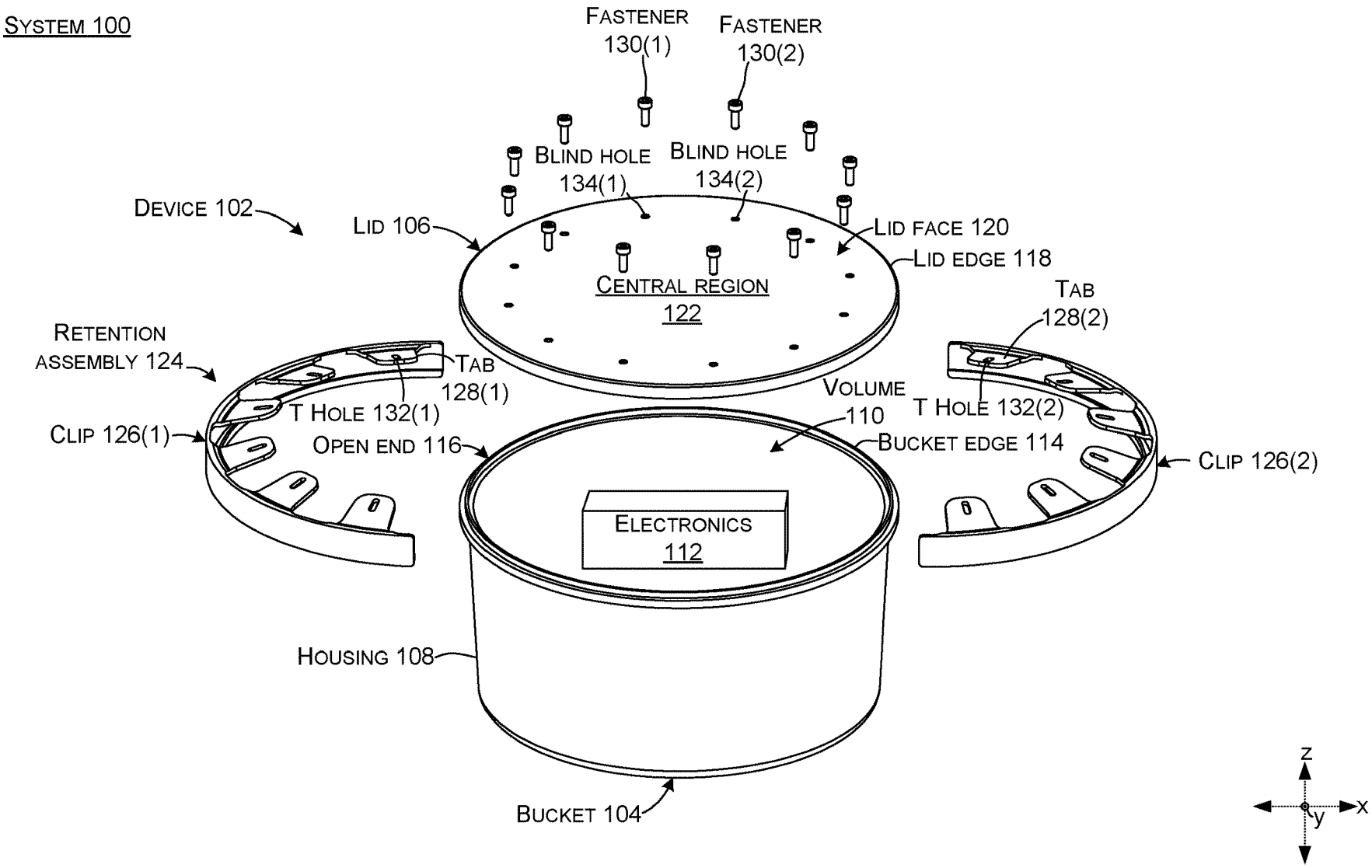
FIGS. 1A and 3A show exploded perspective views of example devices and systems in accordance with some implementations of the present concepts.
Figure 1B:
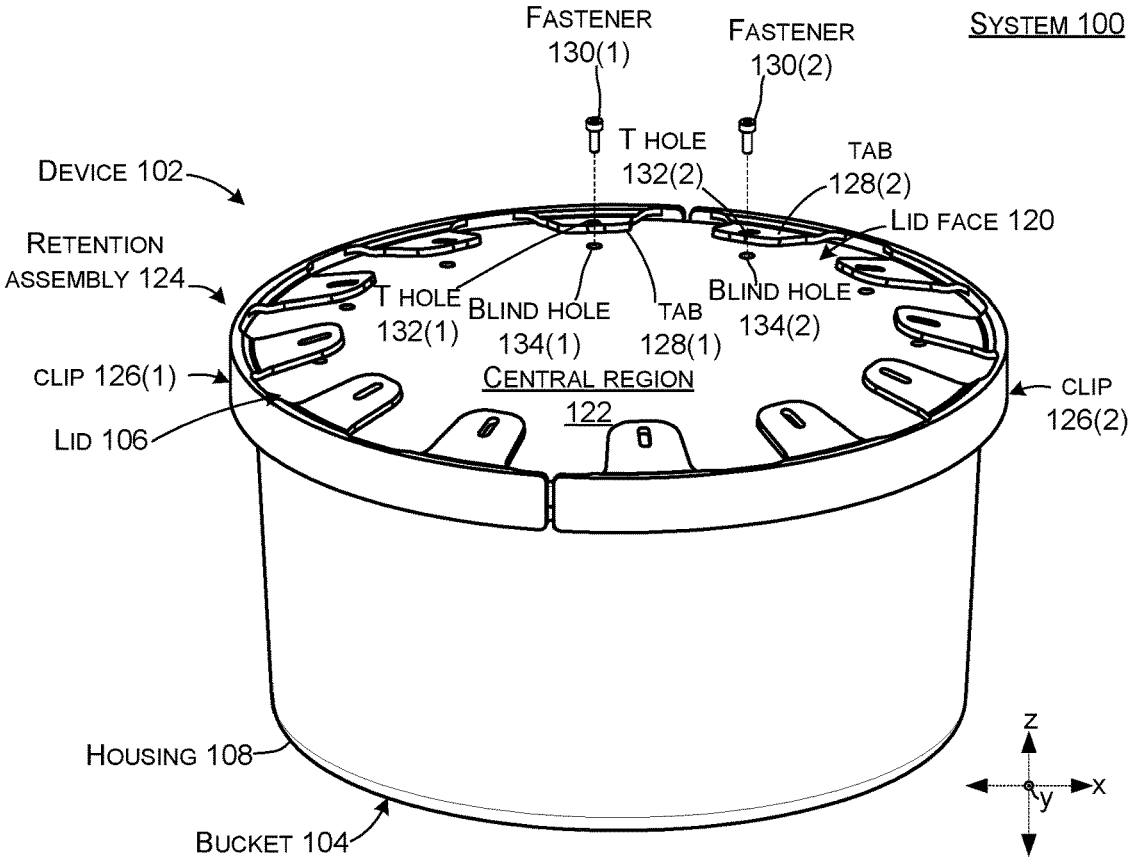
FIGS. 1B, 1C, 3B, and 3C show perspective views of example devices and systems in accordance with some implementations of the present concepts.
Figure 1C:
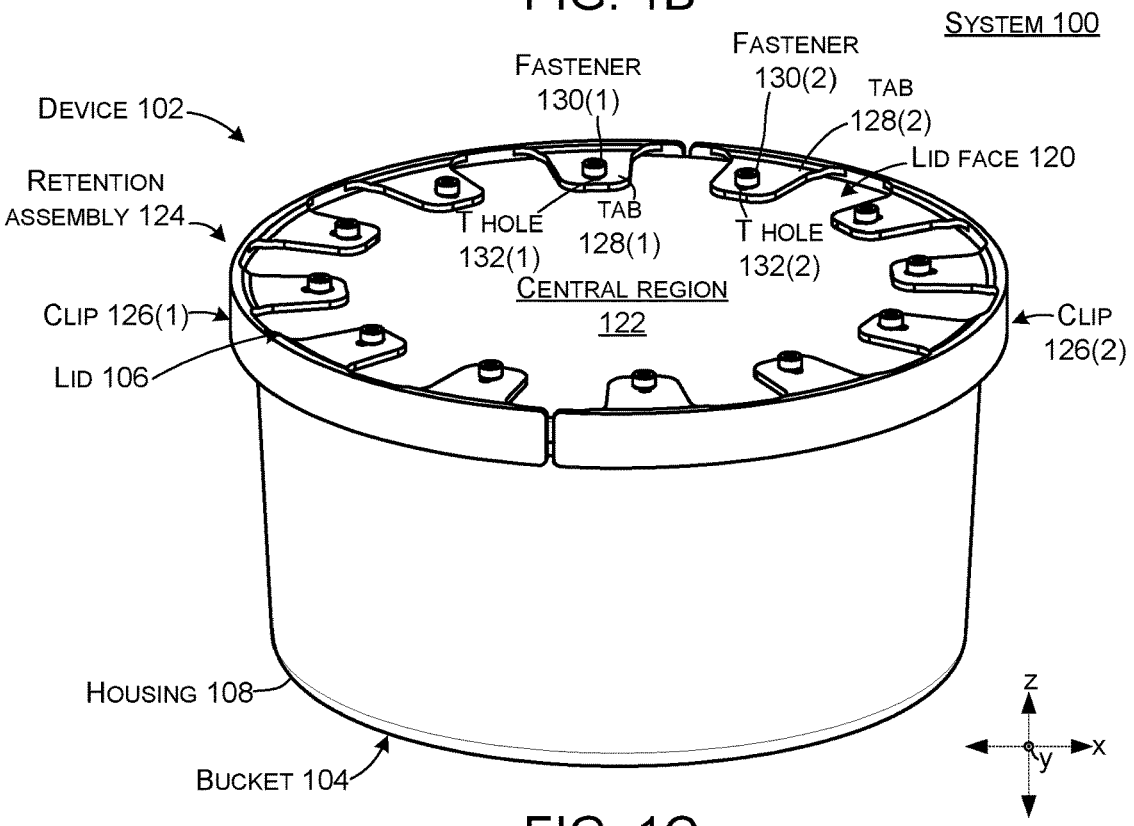

FIGS. 1A-1C collectively show an example system 100 that can include a device 102. FIG. 1A is an exploded view of device 102. FIG. 1B is a view of the assembled device and FIG. 1C is a view of the assembled and sealed device. The device 102 can include a bucket 104 and a lid 106. The bucket 104 can include a housing 108 that defines an internal volume 110. The volume can hold various items, such as electronic components 112. The housing 108 can also include a bucket edge 114 that can define an open end 116.

The lid 106 can include a lid edge (e.g., perimeter) 118 and a lid face 120 that can define a central region 122 of the lid. A retention assembly 124 can position the lid 106 relative to the bucket 104. The retention assembly 124 can include a clip 126 and one or more tabs 128. To avoid clutter on the drawing page only two tabs 128(1) and 128(2) are specifically designated. In this case, two clips are employed (e.g., clips 126(1) and 126(2)) to collectively extend around the lid edge 118 (e.g., perimeter of the lid) and bucket edge 114. However, other implementations can employ a single continuous clip or multiple (e.g., more than two) clips. Further, in this case, the two clips 126(1) and 126(2) are similar and potentially identical to one another. The description below relating to FIGS. 3A-4C explains a two clip configuration where the two clips are configured differently from one another.

Fasteners 130 can be employed to secure the tabs 128 to the lid face 120, such as to the central region 122. For instance, the fasteners 130 can pass through 'through holes' 132 in the tabs 128 and be received in 'blind holes' 134 in the lid 106. In some configurations, the fasteners 130 can be threaded fasteners and the blind holes 134 can be correspondingly threaded to receive the fasteners. Only two fasteners 130 are specifically designated on FIGS. 1A and 1C to avoid clutter on the drawing pages. FIG. 1C shows fasteners 130 securing the lid 106 to the bucket 104. This aspect is described in more detail below relative to FIGS. 2A and 2B.

Figure 2A:
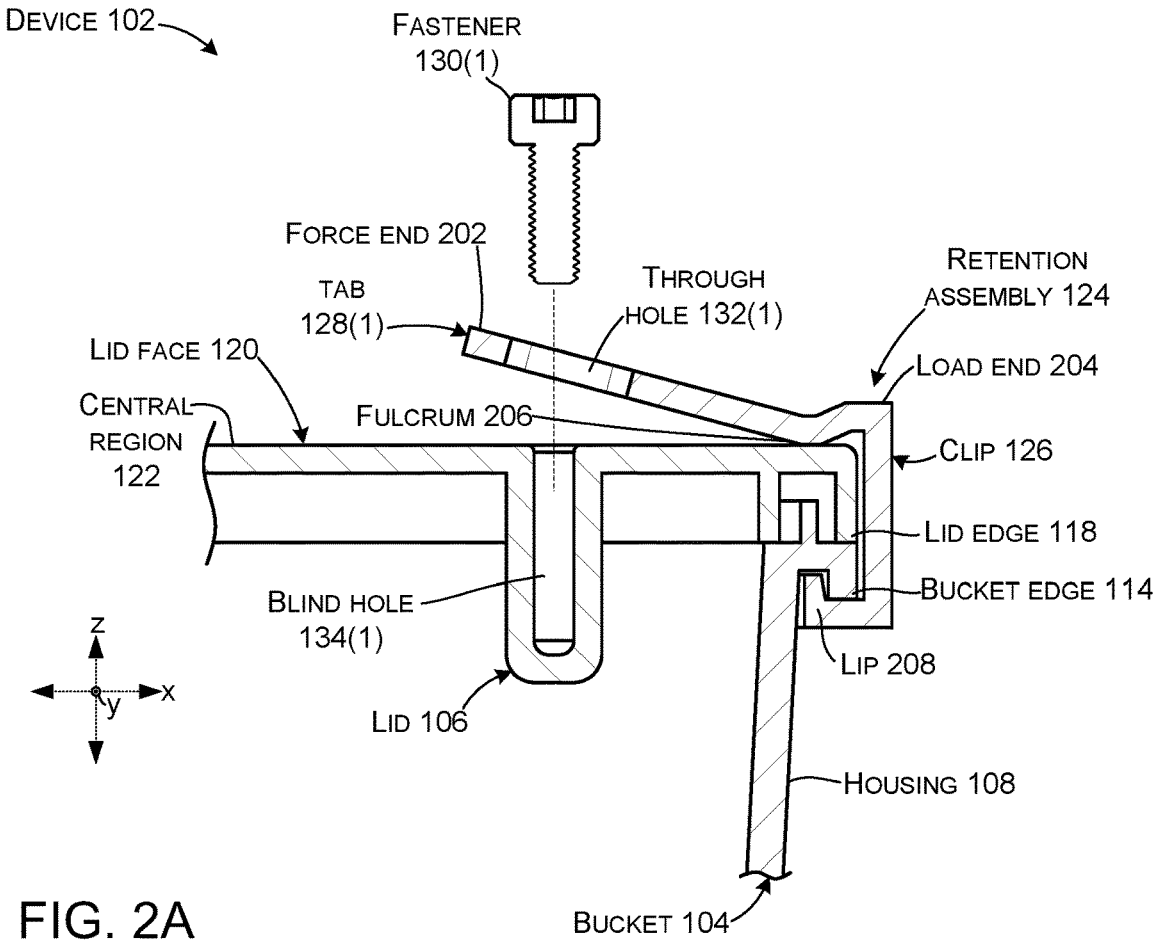
FIGS. 2A, 2B, 4A, 4B, 4C, 5A, 5B, and 5C show sectional views of example devices and systems in accordance with some implementations of the present concepts.
Figure 2B:
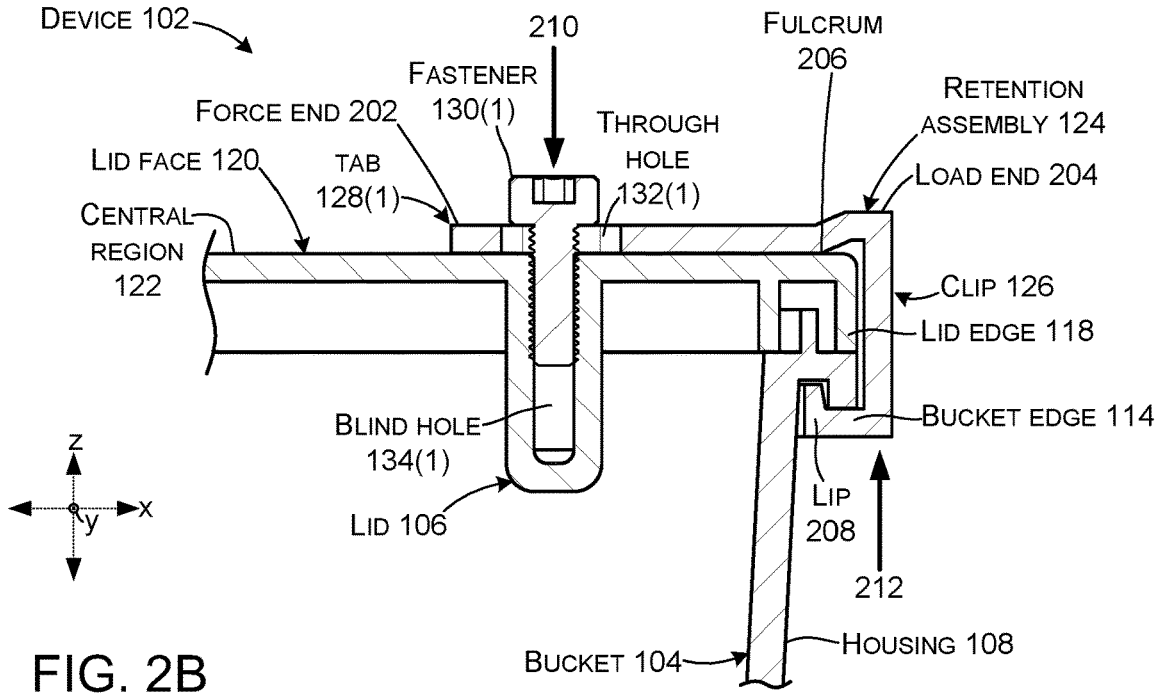

FIGS. 2A and 2B collectively show additional details of portions of the devices shown in FIGS. 1B and 1C, respectively. Some of these details relate to the tabs 128 and clips 126. In this case, the tabs can include a force end (e.g., fastener end) 202 separated from a load end (e.g., perimeter end) 204 by a fulcrum 206. The clip 126 can include a lip 208. The lip 208 can extend around (e.g., wrap around) the bucket edge 114.

Tightening the fastener 130(1) in the blind hole 134(1) can create a downward force (in the −z reference direction) on the force end 202 of the tab 128(1) as indicated by force arrow 210. The fulcrum 206 can cause a resultant upward force on the load end 204 (in the +z reference direction) as indicated by force arrow 212. This force 212 can be transferred to the lip 208. The lip 208 can impart this upward force on the bucket edge 114. In turn the bucket edge 114 can be forced upwardly against the lid edge 118. Thus, the lid edge 118 can be squeezed between the fulcrum 206 and the bucket edge 114 by the force imparted on the force end 202 by the fastener 130. This aspect can be achieved despite that the fastener 130 does not contact the bucket 104. Further, the blind hole 134 maintains the integrity of the lid 106 in that the fasteners 130 do not extend completely through the lid 106. For instance, the lid 106 can constitute a continuous material, such as a waterproof material from lid edge to lid edge. The fasteners can be secured to the lid without penetrating through the waterproof material.

In review of FIGS. 1A-1C, 2A, and 2B collectively, the retention assembly 124 can create a force between the lid 106 and the bucket 104 without the fasteners 130 directly contacting the bucket 104. Further, the fasteners 130 can be secured to the lid 106 without passing through the lid 106, which could otherwise create potential points of failure in the seal (e.g., waterproof nature) of the lid 106. This configuration solves the technical problem of applying forces that bias the lid and the bucket toward one another without creating leak paths through the lid.

Note also, that the tabs 128 are positioned against the lid face 120 and within the perimeter of the lid 106 and the bucket edge 114 (e.g., perimeter of the bucket). As such, the tabs 128 do not increase the size of the perimeter of the device 102 (e.g., do not increase overall dimensions of the device in the xy reference directions). Traditional tabs tend to be positioned outside of the housing 108 along the z reference direction and sticking out in the x and/or y reference directions from the perimeter of the lid and bucket where they are prone to snagging and/or otherwise being unintentionally opened. Thus, the present tab configurations solve the technical problem of forcing the bucket and lid against one another without increasing an overall perimeter of the device and/or being prone to snagging and/or inadvertent opening. Further still, the present tabs 128 can create a force that biases the lid and bucket together without passing entirely through the lid or being fastened to the bucket. The fasteners 130 can be readily removed and the tabs opened so that the lid 106 can be opened to access the electronic components, such as to change a battery. Upon completion, the tabs can be re-closed and the fasteners re-installed.

Figure 3A:
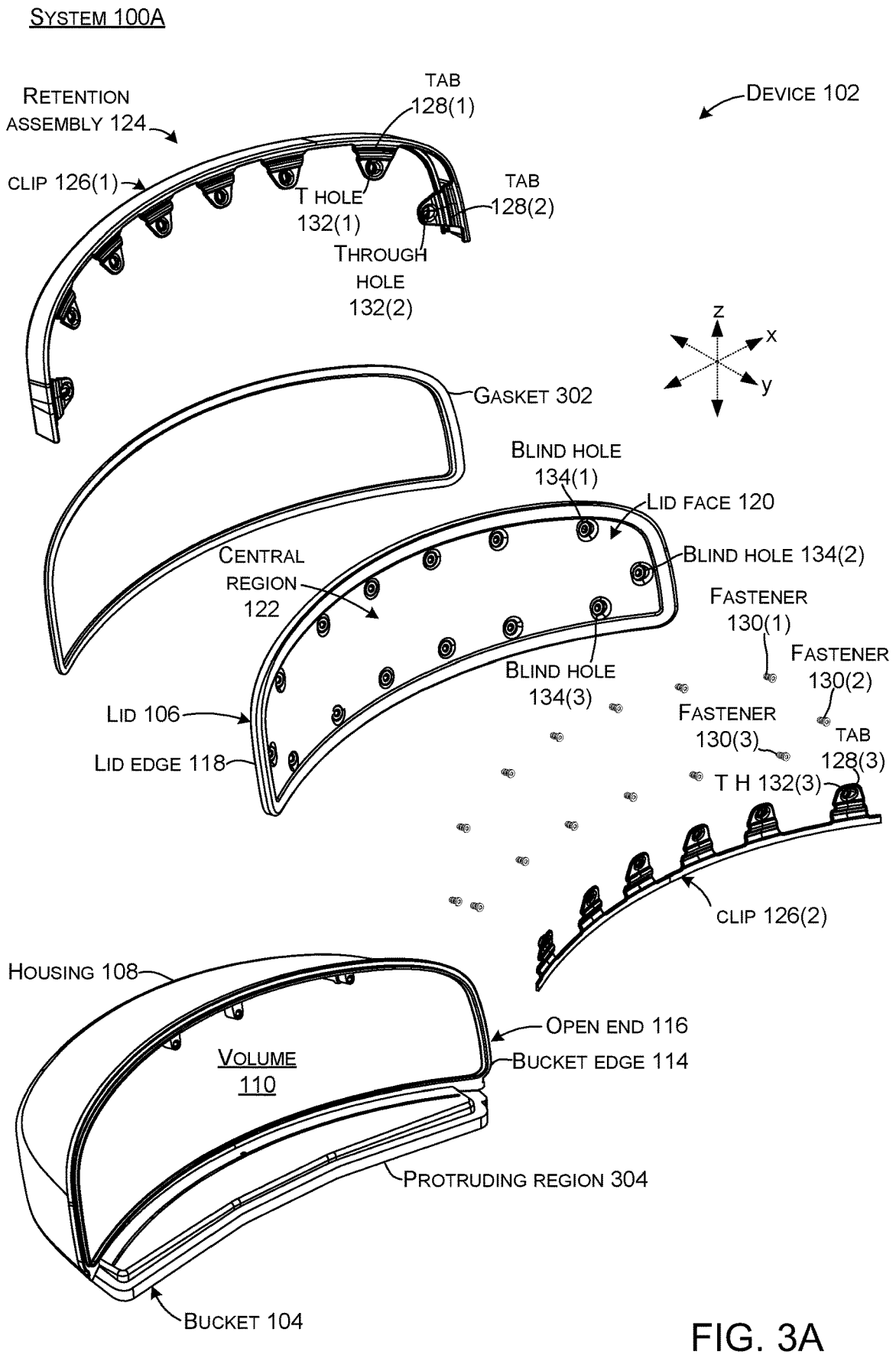
Figure 3B:
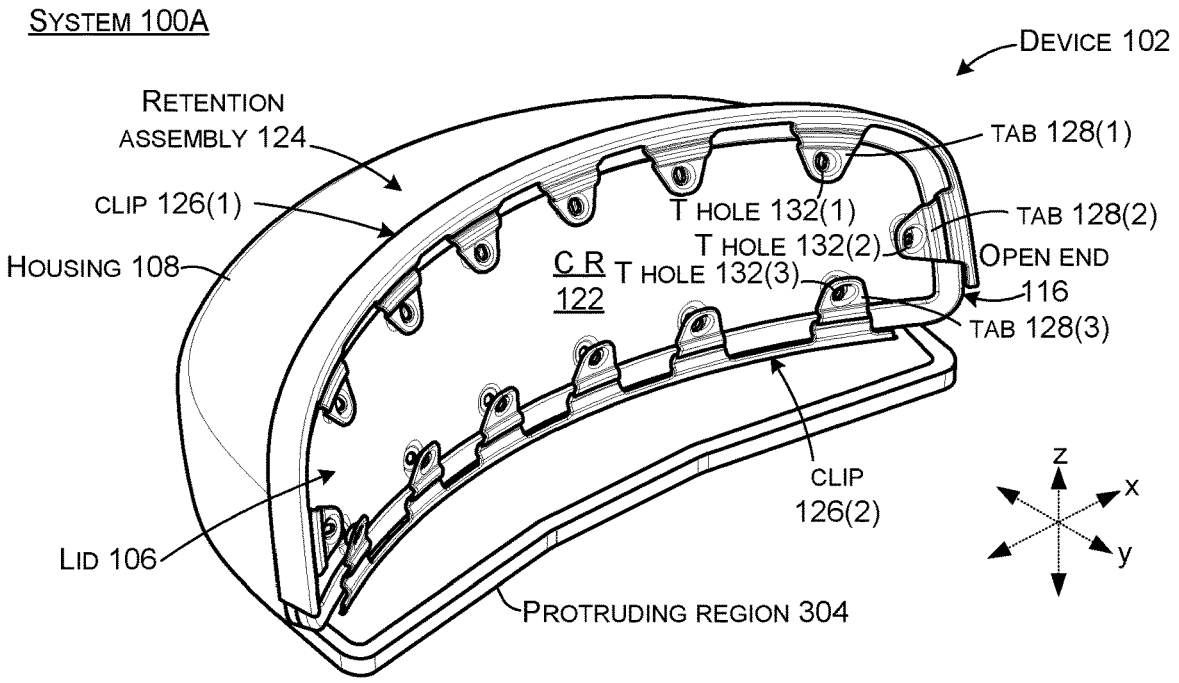
Figure 3C:
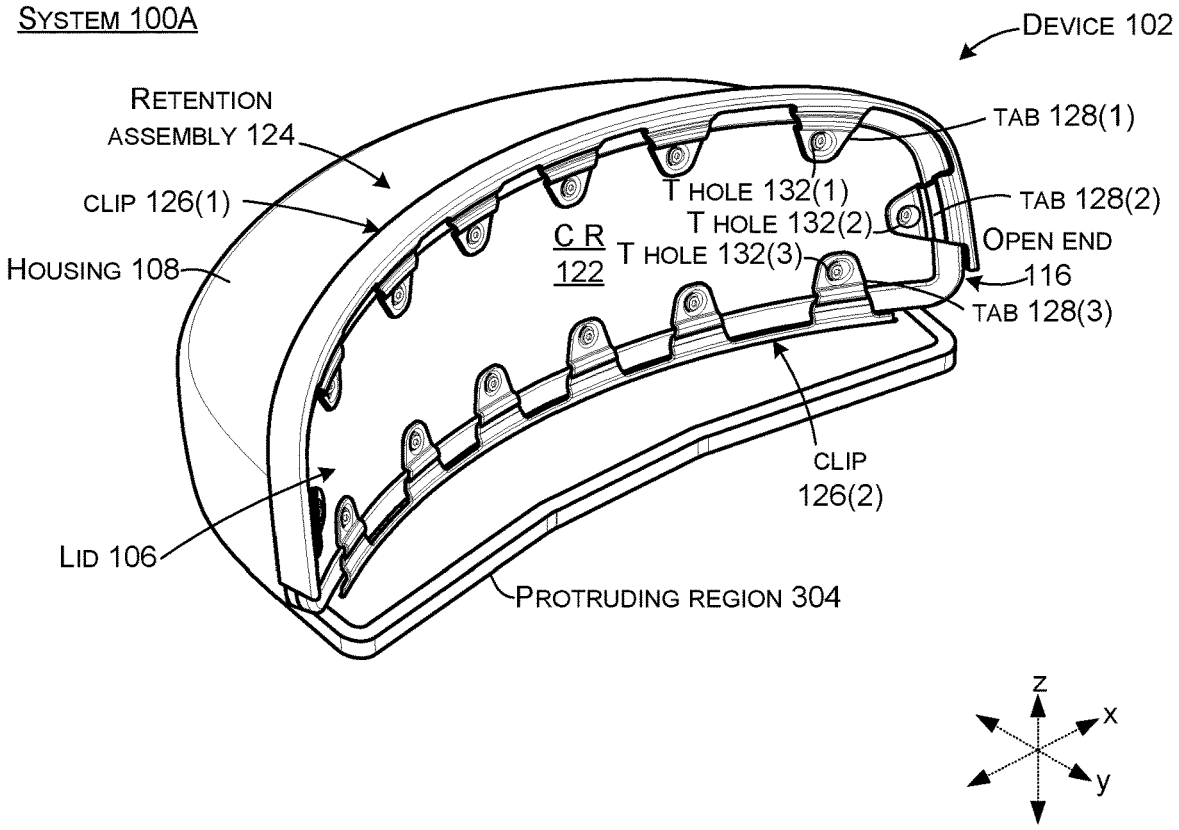
Figure 4A:
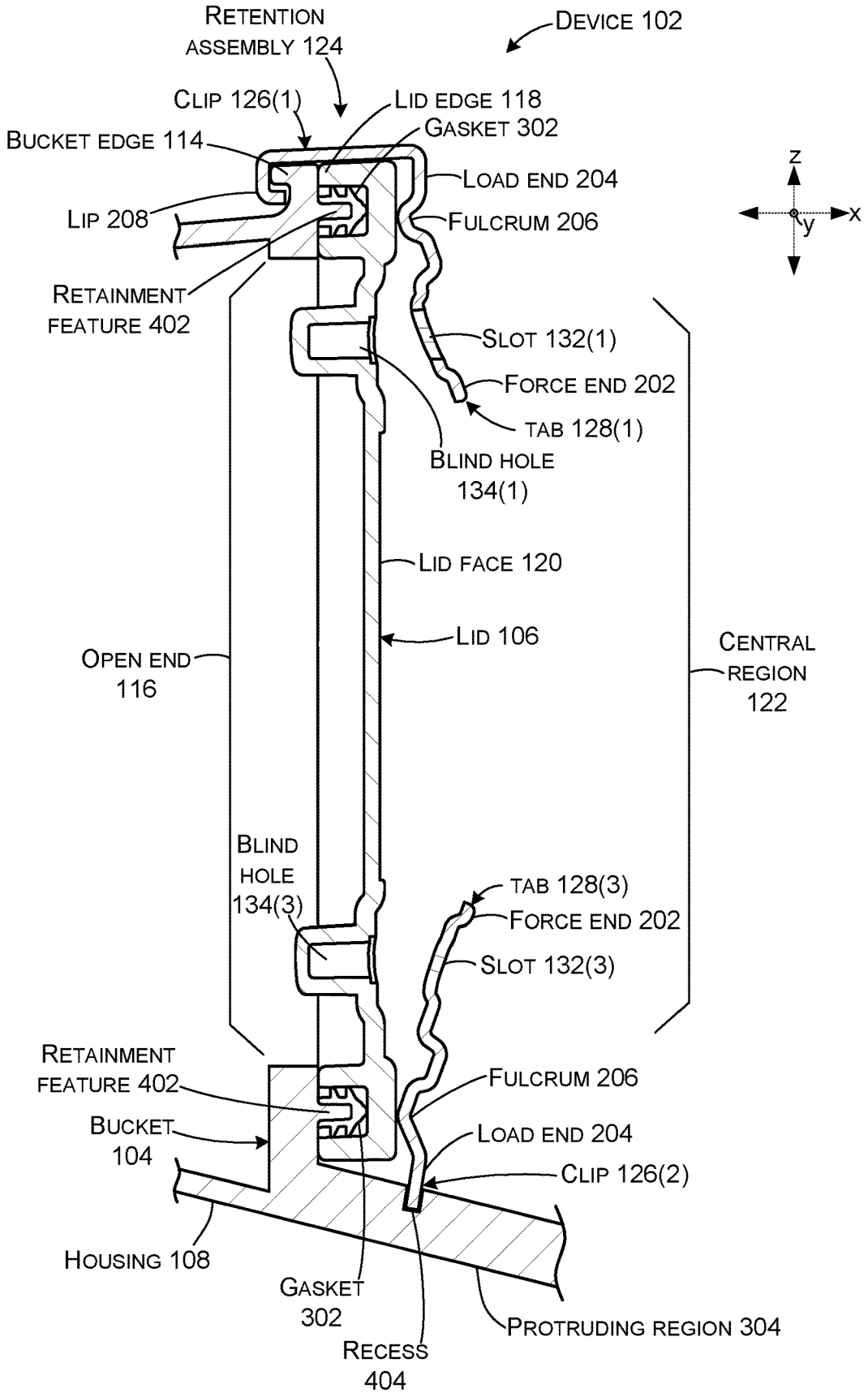
Figure 4B:
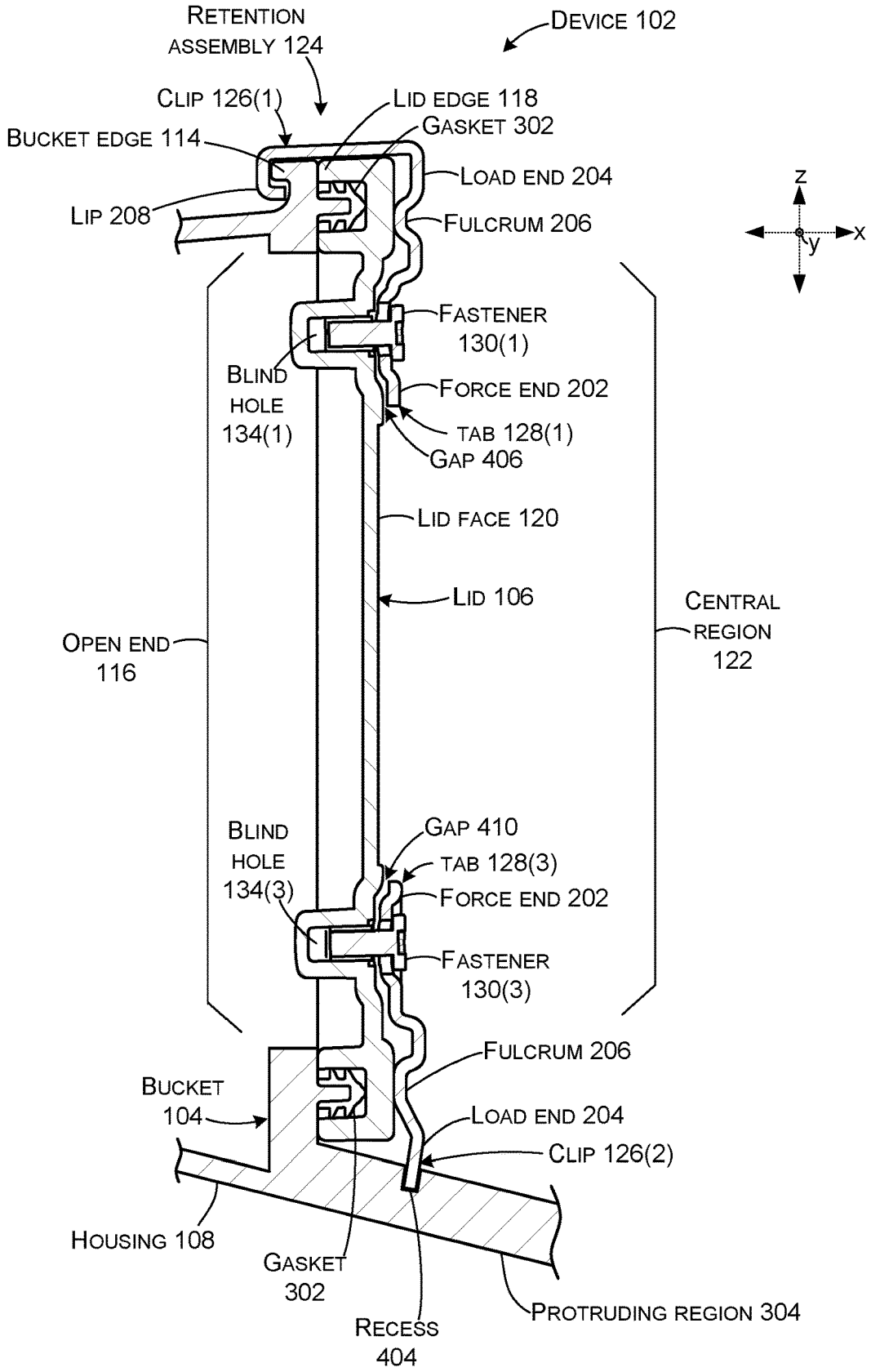
Figure 4C:
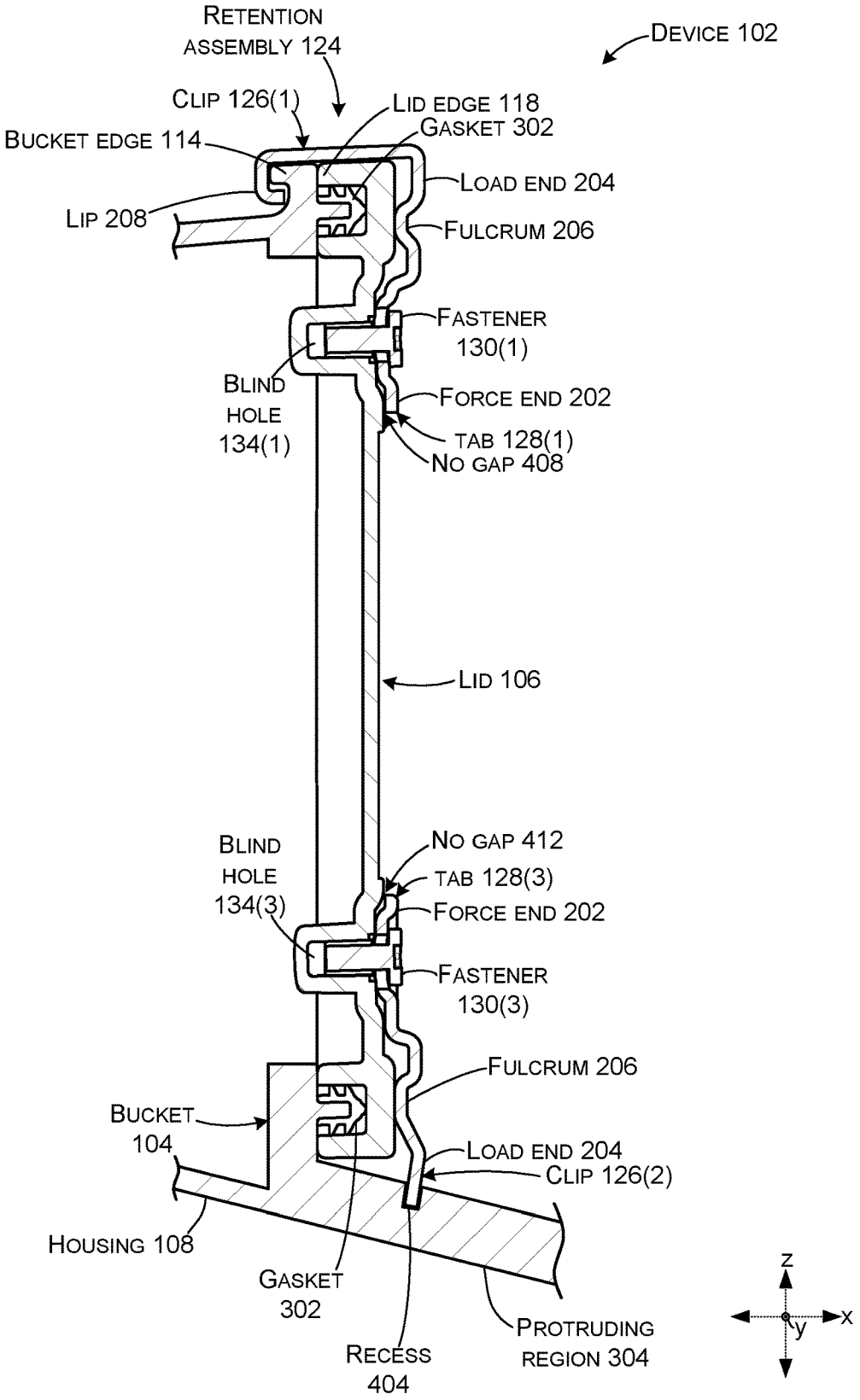

FIGS. 3A-3C and 4A-4C collectively illustrate another example system implementation 100A. The views of FIGS. 3A-3C are similar to the views of FIGS. 1A-1C, respectively. The views of FIGS. 4A and 4C are similar to the views of FIGS. 2A and 2B, respectively. FIG. 4B shows an intermediary view relative to FIGS. 4A and 4C. Example system 100A includes many of the components introduced above relative to FIGS. 1A-1C and 2A and 2B. For sake of brevity, not all of these components are re-introduced in the description that follows. Not all instances of each component are specifically designated to avoid clutter on the drawing page.

In this implementation, device 102 includes bucket 104 having open end 116 that is elongated along the x reference axis. Further, the bucket's open end 116 is concave when considered relative to the xz reference plane. The lid 106 can approximate this elongate and concave nature of the bucket's open end 116 (when acted upon by the retention assembly 124). This implementation can include a gasket 302 that can be secured between the lid 106 and the bucket 104 by the retention assembly 124. The gasket 302 can enhance a seal when compressed between the lid 106 and the bucket 104. In various implementations the gasket can be manifest as an O-ring or other cross-sectional shapes.

In the illustrated configuration, the open end 116 of the bucket 104 does not match an outer profile of the housing 108. Stated another way, the bucket edge 114 of the open end 116 is a subset of the outer profile of the housing 108. In this case, a protruding region 304 is adjacent to the bucket edge 114. The protruding region 304 would interfere with traditional tabs, but does not interfere with the present solutions. Toward this end, the present implementation can employ clips 126 that are adapted for their respective environments (e.g., the configuration of the bucket 104 proximate to the individual clip 126 or portion of a clip). Thus, clip 126(1), which can be employed where the bucket edge matches the housing's outer edge can be configured differently from clip 126(2) where the bucket edge 114 is adjacent to protruding region 304. In this case, a first set of tabs is associated with (e.g., integrated into) clip 126(1) and a second set of tabs is associated with (e.g., integrated into) clip 126(2) in a many to one relationship. Other configurations, such as a one-to-one relationship or a one to many relationship are contemplated. As shown in FIGS. 4A-4C, regardless of the clip configuration, the tabs 128 can close against the lid face 120 with the force ends 202 toward the central region 122 and the load ends 204 toward the lid edge 118.

FIG. 4A shows retention assembly 124 assembled on bucket 104 and lid 106. In this case, gasket 302 is positioned between the bucket 104 and the lid 106. In this implementation, the bucket includes a retainment feature 402. The retainment feature 402 can function to keep the gasket 302 in the proper position during assembly so that the gasket does not fall off or get misaligned before being compressed between the lid 106 and the bucket 104 by the retention assembly 124.

Clip 126(1) includes lip 208 that is positioned around bucket edge 114 and the fulcrum 206 is contacting a periphery of the lid face 120 (e.g., proximate to the lid edge 118) from the opposite direction. Clip 126(2) is configured so that the load end 204 transfers energy to the clip 126(2) that is received in a recess 404 in the housing 108. In this case, the recess 404 is in the protruding region 304. At this point, the device is ready for the retainment assembly 124 to generate a force that biases the bucket 104 and the lid 106 against one another.

FIG. 4B shows fastener 130(1) installed relative to tab 128(1) and fastener 130(3) installed relative to tab 128(3). The fasteners are inserted through 'through holes' 132 (labeled FIG. 4A) and threaded into the blind holes 134.

Threading the fastener 130(1) into blind hole 134(1) can create a force on the force end 202 toward the lid 106. The fulcrum 206 can translate this force so that the lip 208 of the clip 126(1) engages and squeezes the bucket 104 and the lid 106 toward one another between the fulcrum 206 and the lip 208. In the illustrated configuration, the amount of force can be adjusted based at least in part upon how far the fastener 130(1) is screwed into the blind hole 134(1). For instance, as illustrated in FIG. 4B, a gap 406 still remains between the force end of the tab 128(1) and the lid face 120. As illustrated in FIG. 4C, the fastener 130(1) has been screwed farther in until no gap remains as indicated at 408. Thus, more force can be created between the lid 106 and the tab 128(1) by the fastener 130(1) in the illustrated configuration of FIG. 4C than that of FIG. 4B. This force can be readily adjusted, such as by adjusting the gap and/or by adjusting the torque value imparted to tighten or loosen the fastener. Other configurations may employ tabs 128(1) of a resilient springy material, such as stainless steel. In such a case, the fastener 130(1) can be fully tightened as shown in FIG. 4C and the tab 128(1) will flex to maintain the force in a range defined by the properties of the tab 128(1). Whatever force is imparted between the lid 106 and the fastener 130(1) can be transferred to the load end 204 and ultimately the bucket 104 by the fulcrum 206 as explained above.

In relation to tab 128(3), threading the fastener 130(3) into blind hole 134(3) can create a force on the force end 202 toward the lid 106. The fulcrum 206 can translate this force so that the load end 204 and ultimately clip 126(3) positioned in the recess 404 operates against the bucket 104 and forces the bucket against the lid 106. From one perspective, the lid 106 (and the gasket 302) can be squeezed between the fulcrum 206 and the bucket 104. The force can be adjusted based at least in part upon the extent of gap 410 or lack thereof (e.g., no gap 412). The gap 410 can be controlled with the fastener 130(3).

FIGS. 3A-3C and 4A-4C show how the retention assembly 124 can accommodate various configurations of buckets 104 with clips 126 and tabs 128 that are configured to operate with the local configuration of the bucket. In this example, the top and sides of the bucket 104 have one general localized configuration that is addressed by clip 126(1). The bottom of the bucket 104 has another localized configuration that is addressed by clip 126(2). In this case, tabs 128(1) and 128(2) are associated with clip 126(1). Similarly, tab 128(3) is associated with clip 126(2). Individual tabs associated with individual clips can be adjusted (via adjusting their fasteners) to adjust the localized force between the lid 106 and the bucket 104.

While two clips 126 are illustrated in this implementation, additional different clips could be employed to address different localized bucket configurations. Whatever bucket conditions are encountered, the retention assembly 124 can provide a force that biases the bucket 104 and lid 106 toward one another directly or indirectly against gasket 302. The biasing force can be achieved with fasteners 130 that secure tabs 128 to a central region 122 of the lid face 120. The fasteners 130 can be received in blind holes 134 in the lid 106 that do not compromise a barrier, such as a waterproof barrier, provided by the lid 106. The fulcrums 206, load ends 204 and clips 126 can transfer this force to the bucket edge 114 to bias the bucket 104 and lid 106 toward one another.

The example above includes clips 126 that collectively run along the entire open end 116 of the bucket 104 to force the bucket 104 and the lid 106 against one another. However, other implementations may run along less than an entirety of the open end while forcing the bucket 104 and the lid 106 against one another. One such example is described below relative to FIGS. 5A-5C.

Figures 5A, 5B, 5C:
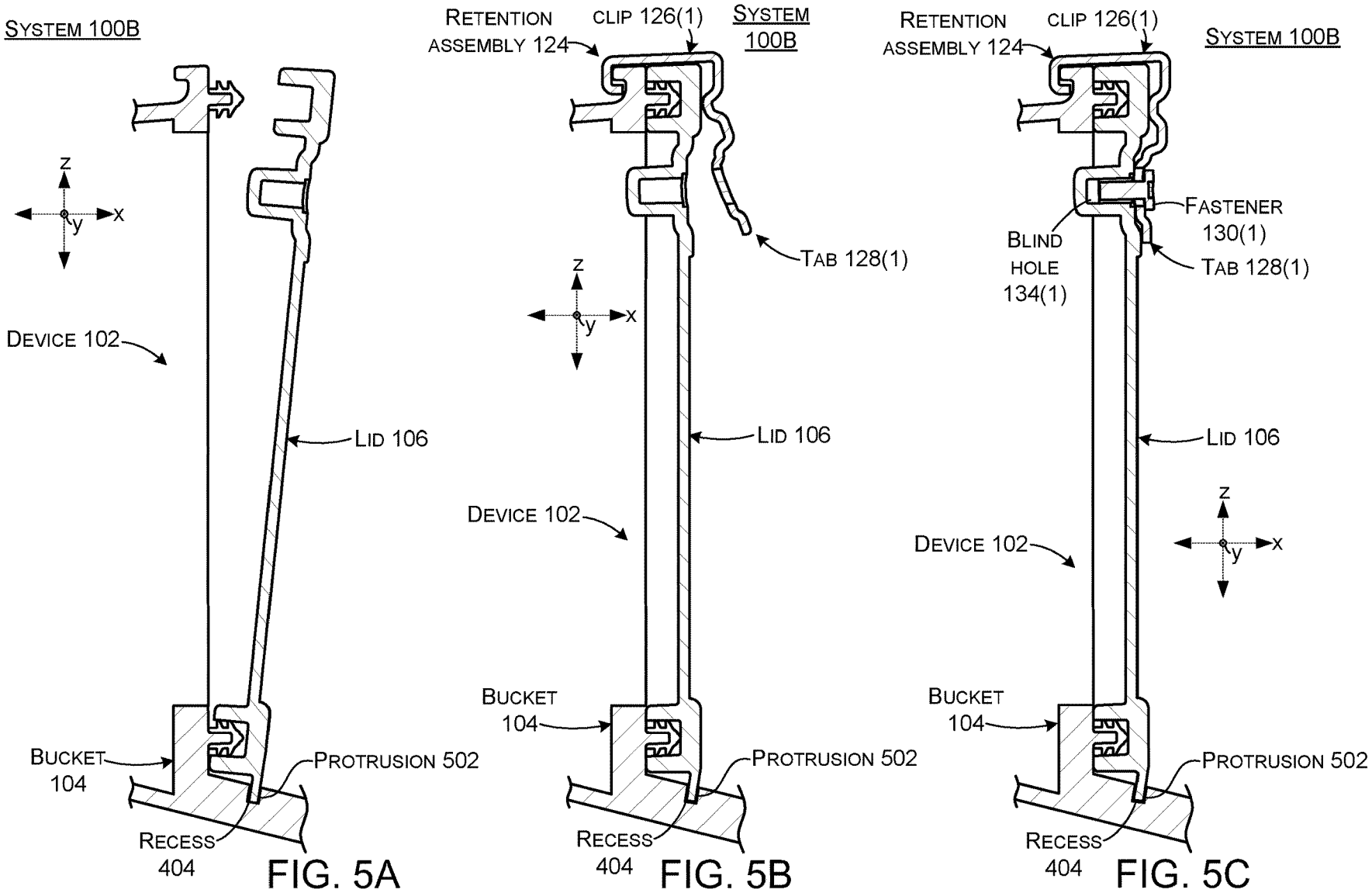

FIGS. 5A-5C shows another example system 100B that includes device 102. In this case, the lower region of the lid 106 includes a protrusion 502 that fits into recess 404 in the bucket 104. As shown in FIG. 5A, the protrusion 502 can be positioned in the recess 404 with the top region tilted outwardly away from the bucket 104. FIG. 5B shows that the top region of the lid 106 can then be rotated toward the bucket 104 and the clip 126(1) of the retention assembly 124 can be installed over the bucket 104 and the lid 106 at the upper region. This rotation can create a clamping force on the lower region because the recess 404 and protrusion 502 collectively prevent the lower region of the lid 106 from rotating away from the lower region of the bucket 104.

FIG. 5C shows that the fastener 130(1) can be installed through the tab 128(1) into the blind hole 134(1). Tightening the fastener 130(1) can create a biasing force on the tab 128(1), which can be transferred to the lid 106 and the bucket 104 by the clip 126(1). This tightening of the fastener 130(1) on the tab 128(1) and the resultant biasing force can also maintain the force on the lower regions of the bucket 104 and lid 106 against one another. Thus, this implementation illustrates that clips 126 and tabs 128 can be secured to the bucket 104 and lid 106 to create localized forces on the lid 106 and bucket 104 against one another as well as forces on other regions of the lid and bucket that may not be locally associated with clips and tabs.

The present concepts can relate to devices that include retention assemblies that bias buckets and lids together. The retention assemblies can include one or more clips and tabs. The tabs can be secured to the face of the lid without sacrificing barrier integrity of the lid and without engaging the bucket. The tabs can generate a force that can be imparted on the clips to bias the lid and bucket together to create a seal, such as an air and/or water tight seal. Positioning the tabs on the face of the lid can reduce overall dimensions of the device and reduce incidences of tabs inadvertently snagging objects in an operating environment of the device. Forces generated by the tabs to bias the bucket and lid against one another can be readily adjusted by adjusting the fasteners that secure the tabs to the central region of the lid.

Various methods of manufacture, assembly, and/or use for retention assemblies are contemplated beyond those shown above relative to FIGS. 1A-5C. The buckets and lids can be formed from various materials, such as polymers or metals. For instance, the buckets and/or lids can be machined from solid stock, molded, and/or 3D printed, among other techniques. The clips and tabs can be made from various materials, such as the same materials employed for the lid and bucket or from different materials. Example materials can include polymers and/or metals, among others. The clips and tabs can be integrated components or can be separate components that are secured together. The clips and tabs can be machined from solid stock, molded, and/or 3D printed, among other techniques.

Although techniques, methods, devices, systems, etc., pertaining to retention assemblies are described in language specific to structural features and/or methodological acts, it is to be understood that the subject matter defined in the appended claims is not limited to the specific features or acts described. Rather, the specific features and acts are disclosed as example forms of implementing the claimed methods, devices, systems, etc.

Various examples are described above. Additional examples are described below. One example includes a system comprising a bucket having an open end and defining a volume that contains electronic components, a lid positioned over the open end of the bucket and a retention assembly configured to bias the lid against the bucket to seal the open end, the retention assembly comprising a tab that is secured to the lid with a fastener that extends through the retention assembly into a central region of the lid without extending completely through the lid and does not contact the bucket.

Another example can include any of the above and/or below examples where the tab comprises a single tab associated with a single fastener or wherein the tab comprises multiple tabs associated with multiple fasteners.

Another example can include any of the above and/or below examples where all of the multiple tabs are identical or wherein individual tabs have different configurations from one another.

Another example can include any of the above and/or below examples where the multiple tabs comprise a first set of tabs associated with a first clip that contacts a first region of the bucket and a second set of tabs associated with a second clip that contacts a second region of the bucket, or wherein individual tabs are associated with individual clips and wherein the individual clips are configured to engage a local region of the bucket.

Another example can include any of the above and/or below examples where the tab engages the bucket at an edge of the lid and extends toward the central region of the lid.

Another example can include any of the above and/or below examples where the tab includes a fulcrum configured to be forced against the lid by the fastener.

Another example can include any of the above and/or below examples where the fastener extends through a through hole in the tab into a blind hole in the central region.

Another example can include any of the above and/or below examples where the fastener is a threaded fastener and the blind hole is a correspondingly threaded blind hole in the lid that is configured to receive the threaded fastener.

Another example can include any of the above and/or below examples where the system further comprises a gasket positioned between the lid and the bucket, and wherein the retention assembly compresses the gasket between the lid and the bucket to create the seal.

Another example can include any of the above and/or below examples where the threaded fastener can be adjusted to adjust compression of the gasket between the lid and the bucket.

Another example includes a device comprising a bucket having an open end, a lid positioned over the open end of the bucket and a retention assembly configured to bias the lid against the bucket to seal the open end, the retention assembly comprising a tab extending from an edge of the open end toward a central region of the lid and configured to transfer a force between the central region and the tab to create the bias of the lid against the bucket.

Another example can include any of the above and/or below examples where the tab comprises multiple tabs and at least some of the tabs are associated with clips that wrap around an outer edge of the bucket.

Another example can include any of the above and/or below examples where at least some of the tabs are configured to be received in a recess in the bucket.

Another example can include any of the above and/or below examples where the tabs are fastened to but do not pass completely through the lid.

Another example can include any of the above and/or below examples where the device further comprises a gasket positioned between the lid and the bucket, and wherein the biasing force created by the tabs biases the lid and the bucket against the gasket to create a waterproof seal.

Another example can include any of the above and/or below examples where the tab is associated with a clip that engages an edge of the bucket, and wherein the clip goes around an entirety of the edge of the bucket, or wherein the clip goes around less than the entirety of the edge of the bucket.

Another example includes a device comprising a bucket containing electronic components and having a concave open end, a lid having a face positioned over the concave open end of the bucket and tabs configured to bias the lid and the bucket toward one another at the open end, the tabs comprising perimeter ends separated from fastener ends by fulcrums and the fastener ends and the fulcrums are positioned on the face of the lid.

Another example can include any of the above and/or below examples where the concave open end is elongated along an axis and wherein at least some of the tabs on a first side of the axis extend around a perimeter of the lid and over a lip of the bucket and wherein at least some other tabs on a second side of the axis extend into recesses on the open end of the bucket.

Another example can include any of the above and/or below examples where the fastener ends can be loosened and tightened relative to the face of the lid to adjust the bias.

Another example can include any of the above and/or below examples where the lid comprises a waterproof material and wherein the fasteners do not penetrate through the waterproof material of the lid.

The invention claimed is:

1. A system, comprising:

a bucket having an open end and defining a volume that contains electronic components;

a lid positioned over the open end of the bucket; and, a retention assembly configured to bias the lid against the bucket to seal the open end, the retention assembly comprising a clip secured to a tab, the tab comprising a load end proximate to the clip and a force end away from the clip and a fulcrum interposed between the load end and the force end, the clip configured to engage the bucket, a fastener extending in a first direction through the force end into a central region of the lid is configured to move the force end toward the central region and cause the fulcrum to contact the lid and impart a force on the clip in an opposite direction to increase the bias between the lid and the bucket.

2. The system of claim 1, wherein the tab comprises a single tab associated with a single fastener or wherein the tab comprises multiple tabs associated with multiple fasteners.

3. The system of claim 2, wherein all of the multiple tabs are identical or wherein individual tabs have different configurations from one another.

4. The system of claim 3, wherein the multiple tabs comprise a first set of tabs associated with a first clip that contacts a first region of the bucket and a second set of tabs associated with a second clip that contacts a second region of the bucket, or wherein individual tabs are associated with individual clips and wherein the individual clips are configured to engage a local region of the bucket.

5. The system of claim 1, wherein the tab engages the bucket at an edge of the lid and extends toward the central region of the lid.

6. The system of claim 5, wherein the clip is positioned around an edge of the bucket and the fulcrum is positioned centrally from the clip and the force end of the clip is positioned centrally from the fulcrum.

7. The system of claim 5, wherein the fastener extends through a through hole in the tab into a blind hole in the central region.

8. The system of claim 7, wherein the fastener is a threaded fastener and the blind hole is a correspondingly threaded blind hole in the lid that is configured to receive the threaded fastener.

9. A device, comprising:

a bucket having an open end defined by a bucket edge;

a lid positioned over the open end of the bucket to align a lid edge with the bucket edge; and, a retention assembly configured to bias the lid edge against the bucket edge to seal the open end, the retention assembly comprising a clip configured to capture the bucket edge between the clip and the lid edge, the retention assembly comprising a tab extending from the clip to a force end positioned toward a central region of the lid that is interior to the bucket edge and the lid edge, the tab including a fulcrum positioned between the clip and the force end, the fulcrum configured to cause movement of the force end of the tab in a direction toward the central region by a fastener secured to the central region to create a force on the clip in an opposite direction to create the bias of the lid edge against the bucket edge.

10. The device of claim 9, wherein the tab comprises multiple tabs and at least some of the tabs are associated with individual clips that wrap around an outer edge of the bucket.

11. The device of claim 10, wherein the fastener extends into but does not pass completely through the lid.

12. The device of claim 9, wherein the tab is associated with the clip that engages an edge of the bucket, and wherein the clip goes around an entirety of the edge of the bucket, or wherein the clip goes around less than the entirety of the edge of the bucket.

13. A device, comprising:

a bucket having an open end defined by a bucket edge;

a lid having a lid edge that aligns with the bucket edge; and, a clip that comprises a lip that wraps at least part way around the bucket edge, the clip is attached to multiple tabs at fulcrums that oppose the lip and movement of the tabs in a first direction toward the lid by fasteners secured to the lid is translated by the fulcrums to cause movement of the lip in an opposite direction to bias the bucket edge and the lid edge toward one another.

14. The system of claim 1, wherein the tab comprises multiple tabs associated with the clip.

15. The system of claim 14, wherein the clip comprises a single clip or wherein the clip comprises multiple clips.

16. The system of claim 15, wherein each of the multiple clips is associated with multiple tabs.

17. The device of claim 9, wherein the tab comprises multiple tabs associated with the clip.

* * * * *